US007605379B2

(12) United States Patent
Xiao et al.

(10) Patent No.: US 7,605,379 B2
(45) Date of Patent: Oct. 20, 2009

(54) COLD-CATHODE-BASED ION SOURCE ELEMENT

(75) Inventors: Lin Xiao, Beijing (CN); Yuan-Chao Yang, Beijing (CN); Li Qian, Beijing (CN); Liang Liu, Beijing (CN); Pi-Jin Chen, Beijing (CN); Zhao-Fu Hu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 156 days.

(21) Appl. No.: 11/877,593

(22) Filed: Oct. 23, 2007

(65) Prior Publication Data

US 2008/0277592 A1 Nov. 13, 2008

(30) Foreign Application Priority Data

May 9, 2007 (CN) ..... 2007 1 0074322

(51) Int. Cl.
*H01J 49/10* (2006.01)
*H01J 27/02* (2006.01)

(52) U.S. Cl. ..... 250/423 R; 250/423 F; 250/426; 315/111.81; 315/111.91

(58) Field of Classification Search ..... 250/423 R, 250/423 F, 426; 315/111.81, 111.91
See application file for complete search history.

(56) References Cited

U.S. PATENT DOCUMENTS

| | | | | |
|---|---|---|---|---|
| 4,737,688 | A * | 4/1988 | Collins et al. | 315/111.21 |
| 6,139,760 | A | 10/2000 | Shim et al. | |
| 7,332,714 | B2 * | 2/2008 | Watanabe et al. | 250/283 |
| 2006/0202701 | A1 | 9/2006 | Knapp et al. | |
| 2007/0051965 | A1 | 3/2007 | Du et al. | |

FOREIGN PATENT DOCUMENTS

| | | | |
|---|---|---|---|
| CN | 1670886 | A | 9/2005 |

* cited by examiner

*Primary Examiner*—Nikita Wells
(74) *Attorney, Agent, or Firm*—D. Austin Bonderer

(57) ABSTRACT

An ion source element includes a cold cathode, a grid electrode, and an ion accelerator. The cold cathode, the grid electrode, and the ion accelerator are arranged in that order and are electrically separated from one another. A space between the cold cathode and the grid electrode is essentially smaller than a mean free path of electrons at an operating pressure. The ion source element is thus stable and suitable for various applications.

10 Claims, 1 Drawing Sheet

COLD-CATHODE-BASED ION SOURCE ELEMENT

RELATED APPLICATIONS

This application is related to commonly-assigned, application: U.S. patent application Ser. No. 11/877,590, entitled "IONIZATION VACUUM GAUGE", filed Oct. 23, 2007. The disclosure of the respective above-identified application is incorporated herein by reference.

BACKGROUND

1. Field of the Invention

The invention relates to ion source elements and, particularly, to a stable ion source element.

2. Discussion of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs are electrically conductive along their length, are chemically stable, and can each have a very small diameter (much less than 100 nanometers) and a large aspect ratio (length/diameter). Due to these and other properties, it has been suggested that carbon nanotubes can play an important role in a variety of fields, such as microscopic electronics, field emission devices (FED), scanning electron microscopes (SEM), transmission electron microscopes (TEM), etc.

One conventional type of ion source element includes a cold cathode with a CNT film formed thereon, a grid electrode arranged above the cold cathode, and an ion accelerator arranged above the grid electrode (i.e., the grid electrode is positioned between the cold cathode and the ion accelerator). The CNT film acts as an electron emitter for the ion source element, and, consequently, the ion source element has a low power consumption and a low evaporation rate. In operation, electrons emit from the CNT film and travel to the grid electrode, and such electrons are eventually collected by the grid electrode. The ion source element operated in a certain vacuum level, and there are still some gas molecules and/or atoms therein. In their travel, electrons bombard with the gas molecules and/or atoms and, thereby, create gas ions. The gas ions and electrons bombard with the CNT film or/and interact with the CNT film, and then the CNT film can be locally destroyed and/or transformed. Therefore, the ion source element can be unstable, over an extended period of use.

What is needed, therefore, is an ion source element that is stable and suitable for a variety of applications.

SUMMARY

In one embodiment, an ion source element includes a cold cathode, a grid electrode, and an ion accelerator. The cold cathode, the grid electrode, and the ion accelerator are arranged in that order and are electrically separated from one another. A space between the cold cathode and the grid electrode is essentially smaller than a mean free path of electrons at a certain pressure, for example, less than or equal to 2 millimeters at the pressure of less than $10^{-3}$ Torr.

Compared with the conventional ion source element, the space between the cold cathode and the grid electrode is smaller than about the mean free path of electrons at the operating pressure of the ion source element. Thus, fewer electrons bombard with and ionize the gas molecules and/or atoms, and, as a result, fewer gas ions are producted. The probability of the gas ions bombarding with the cold cathode is decreased, and consequently, the present ion source element is more stable over a longer period and, thus, suitable for various applications.

Other advantages and novel features of the present ion source element will become more apparent from the following detailed description of preferred embodiments when taken in conjunction with the accompanying drawings.

BRIEF DESCRIPTION OF THE DRAWINGS

Many aspects of the present ion source element can be better understood with reference to the following drawings. The components in the drawings are not necessarily to scale, the emphasis instead being placed upon clearly illustrating the principles of the present ion source element.

Figure 1:
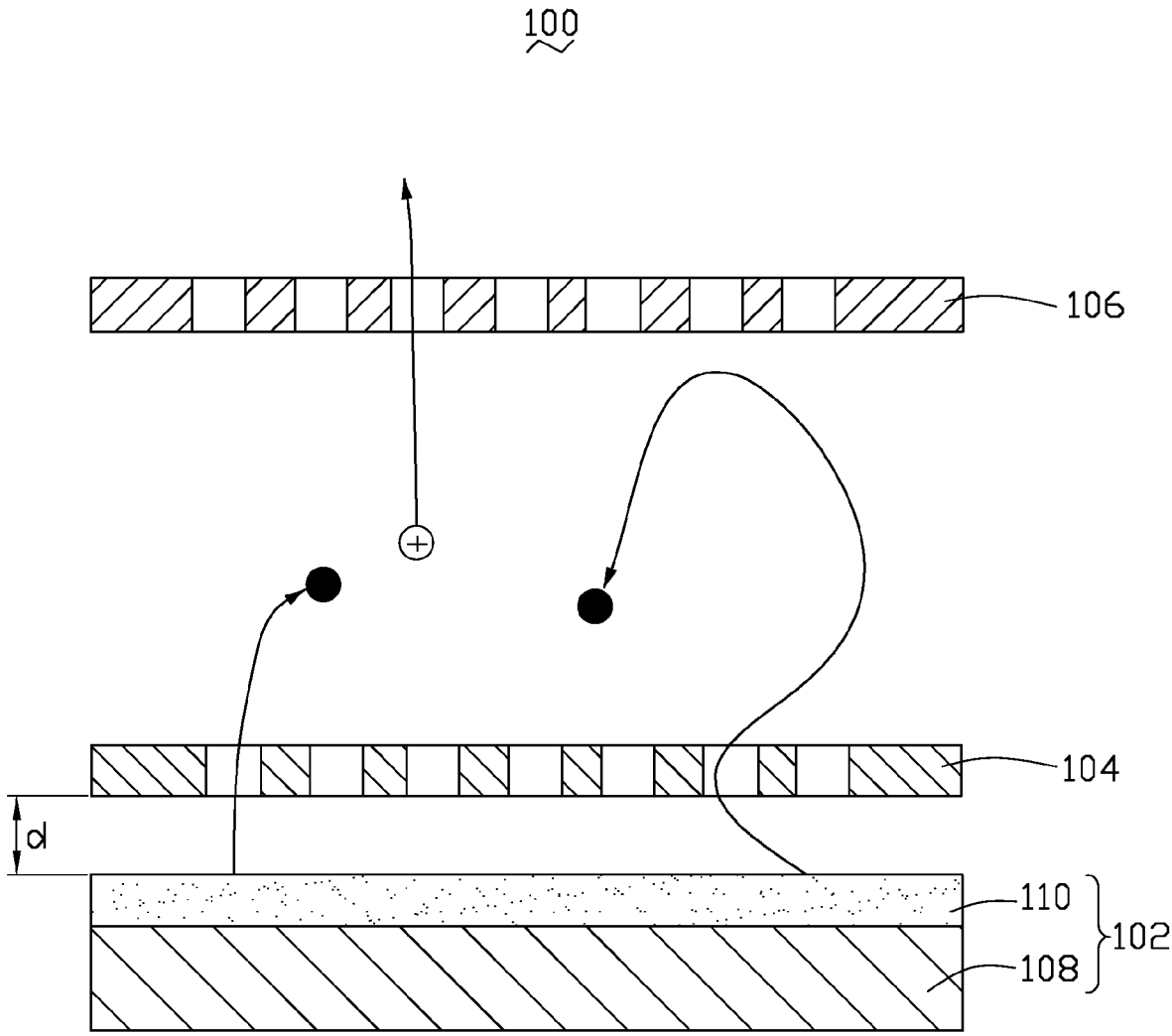
FIG. 1 is a schematic, cross-sectional view, showing an embodiment of the present ion source element.

Corresponding reference characters indicate corresponding parts throughout the several views. The exemplifications set out herein illustrate at least one preferred embodiment of the present ion source element, in one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the present ion source element.

FIG. 1 shows the present ion source element 100. The ion source element 100 includes a cold cathode 102, a grid electrode 104, and an ion accelerator 106. The cold cathode 102, the grid electrode 104, and the ion accelerator 106 are arranged in that order and are electrically separated from one another. That is, the cold cathode 102, the grid electrode 104, and the ion accelerator 106 are mounted in the ion source element 100 so that they are electrically insulated from each other relative to such mounting (details of such mounting are not shown). However, that said, the cold cathode 102, the grid electrode 104, and the ion accelerator 106 are configured in a manner so as not to be shielded from one another, thereby permitting ions and/or free electrons to travel from one two another via the spaces therebetween.

The ion source element 100 is disposed in an enclosure (not shown), and that enclosure is held at a certain level of vacuum, i.e., an operating vacuum. Usefully, the operating vacuum is a pressure of less than about $10^{-3}$ Torr. Additionally, a space between the cold cathode 102 and the grid electrode 104 is beneficially smaller than about a mean free path of electrons in the vacuum. Advantageously, the spacing should be less than or equal to 2 millimeters (mm) for an ion source element 100 being operated, in general, at a pressure of less than about $10^{-3}$ Torr.

The grid electrode 104 and the ion accelerator 106 are opportunely made of an oxidation-resistant conducting metal, such as aluminum (Al), copper (Cu), tungsten (W), or an alloy thereof. The grid electrode 104 and the ion accelerator 106 usefully have apertured structures, such as metallic rings, metallic-enclosed apertures, or metallic nets. A penetration ratio of the grid electrode 104 is more than 80%.

The cold cathode 102 beneficially includes a substrate 108 and a field emission film 110. The field emission film 110 is coated directly on the substrate 108 and is arranged so as to face the grid electrode 104. The substrate 108 is, usefully, a conductive metal plate or an ITO glass. The substrate 108 has a curved surface or a plate/planar surface. Accordingly, the cold cathode 102, the grid electrode 104 and the ion accelerator 106 have correspondingly curved surfaces or the plate surfaces to match the contour of the substrate 108. It is to be understood that another known cold cathode element configuration (e.g., employing a non-film emitter source) and still be within the scope of the present ion source element 100.

The initial material applied in the creation of the field emission film 110 is advantageously composed of carbon nanotubes (CNTs), low-melting-point glass powders, conductive particles, and an organic carrier/binder. The mass percents of the foregoing ingredients are respectively: about 5% to 15% of CNTs, about 10% to 20% of conductive particles, about 5% of low-melting-point glass powders, and about 60% to 80% of organic carrier.

CNTs can be obtained by a conventional method, such as chemical vapor deposition, arc discharging, or laser ablation. Preferably, CNTs are obtained by chemical vapor deposition. A length of CNTs is, advantageously, from 5 microns (μm) to 15 μm, because CNTs less than 5 μm is weak to emit electrons, and CNTs more than 15 μm is easily broken. The organic carrier is composed of terpineol acting as solvent, dibutyl phthalate acting as plasticizer, and ethyl cellulose acting as stabilizer. The low-melting-point glass is melt at temperature from 400° C. to 500° C. The function of the low-melting-point glass is to attach CNTs to the substrate 108 firmly, for avoiding CNTs casting from the substrate 108. The conductive particles can, usefully, be silver or indium tin oxide (ITO). The conductive particles make CNTs electrically conductive to the substrate 108 in a certain degree.

A process for forming such an the cold cathode 102 is illustrated as following steps:

Step 1, providing and uniformly mixing carbon nanotubes (CNTs), low-melting-point glass powders, conductive particles and organic carrier in a certain ration to form a composite slurry;

Step 2, coating the composite slurry on the outer surface of the substrate 108; and Step 3, drying and sintering the composite slurry to form the field emission film 110 on the substrate 108.

In step 2, the composite slurry is provided onto the substrate 108 by a silk-screen printing process. In step 3, drying the composite slurry is to remove the organic carrier, and sintering the composite slurry is to melting the low-melting-point glass powers for attaching CNTs to the substrate 108 firmly. After step 3, the field emission film 110 can further be scrubbed with rubber to expose end portions of CNTs, thus enhancing the electron emission thereof.

Otherwise, the field emission film 110 can be composed essentially of CNTs. CNTs are deposited on the substrate 108 by the conventional method, i.e., CNTs are formed directly on the substrate 108.

In operation of the ion source element 100, an electric voltage is applied between the cold cathode 102 and the grid electrode 104 to cause electrons to emit therefrom. After that, electrons are drawn and accelerated toward the grid electrode 104 by the electric potential. The penetration ratio of the grid electrode 104 is more than 80%, and thus electrons can pass through the grid electrode 104 because of the inertia thereof. The ion accelerator 106 is supplied with a negative electric potential and acts thus to decelerate electrons. Therefore, before arriving at the ion accelerator 106, electrons are drawn back to the grid electrode 104 and eventually are captured by the grid electrode 104. Thus, the cold cathode 102 is stable because of being kept away, on the whole, from such electron bombardment.

In their full range of travel, electrons collide with and ionize gas molecules and/or gas atoms, thereby producing gas ions. Typically, the gas ions are in the form of positive ions. The gas ions in a range between the cold cathode 102 and the grid electrode 104 may bombard with, and consequently, damage the cold cathode 102, and thereby the gas ions in such range should be decreased. Alternatively, the gas ions in a range between the grid electrode 104 and the ion accelerator 106 have less influence on the cold cathode 102. Furthermore, the ion accelerator 106 accelerates ions between the grid electrode 104 and the ion accelerator 106, most of the gas ions can penetrate through the ion accelerator 106 with a certain penetration ratio and can be drawn/pulled out of the ion source element 100.

Therefore, an ionization probability (η) of the gas molecules and/or atoms between the cold cathode 102 and the grid electrode 104 would likely decrease. The ionization probability η is determined by the following equation (1):

$$\eta(d)=1-\exp(d/l), \tag{1}$$

wherein l is a free path of electrons, and d is the space/distance between the cold cathode 102 and the grid electrode 104. To decrease/minimize the ionization probability η of gas molecules and/or atoms, the value of d is essentially smaller than the value of l. The value of l is determined by the following equation (2):

$$l=4\ \mathrm{kT}/(\pi P r^2) \tag{2}$$

wherein k is Boltzman constant, T is absolute temperature, P is pressure of the ion source element, and r is diameter of the gas molecule. That is, the value of l has an exponentially inverse relation with the pressure P of the ion source element. In other word, when the value of d is essentially smaller than the value of l at the pressure P (i.e., the value of l is determined by the value of P), the ionization probability η is decreased, and thus the cold cathode 102 will be less affected by the gas ions. In present embodiment, the ion source element 100 is operated at a pressure less than about $10^{-3}$ Torr and, advantageously, d is less than or equal to about 2 mm to decrease/minimize the ionization probability η of the gas molecules and/or atoms between the cold cathode 102. Therefore, the ion source element 100 is stable, and, can be widely applied into mass spectrographs, vacuum gauges, and ion sources.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. An ion source element comprising:

a cold cathode, a grid electrode, and an ion accelerator arranged in that order and being electrically separated from one another, wherein a space between the cold cathode and the grid electrode is smaller than about a mean free path of electrons at an operation pressure of the ion source element.

2. The ion source element as claimed in claim 1, wherein the cold cathode comprises a substrate and a field emission film coated on the substrate.

3. The ion source element as claimed in claim 2, wherein the field emission film is a film comprising carbon nanotubes.

4. The ion source element as claimed in claim 3, wherein the carbon nanotubes are directly deposited on the substrate.

5. The ion source element as claimed in claim 2, wherein the field emission film is comprised of carbon nanotubes, a low-melting-point glass material, and conductive particles.

6. The ion source element as claimed in claim 3, wherein the length of the carbon nanotubes is approximately from 5 millimeters to 15 millimeters.

7. The ion source element as claimed in claim 1, wherein the grid electrode and the ion accelerator have apertured structures.

8. The ion source element as claimed in claim 7, wherein the apertured structures include at least one of rings, enclosed aperture components, and nets.

9. The ion source element as claimed in claim 7, wherein a penetration ratio of the grid electrode, due to the structure thereof, is more than about 80%.

10. The ion source element as claimed in claim 1, wherein the space between the cold cathode and the grid electrode is less than or equal to 2 millimeters.

* * * * *